US010626838B2

(12) United States Patent
Bergweiler et al.

(10) Patent No.: US 10,626,838 B2
(45) Date of Patent: Apr. 21, 2020

(54) THERMAL STORAGE EXPANSION TANK

(71) Applicants: DENSO International America, Inc., Southfield, MI (US); DENSO CORPORATION, Kariya, Aichi-pref. (JP)

(72) Inventors: Alec Bergweiler, Leverett, MA (US); Dwayne Taylor, Livonia, MI (US); Robert Brinker, Ortonville, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 224 days.

(21) Appl. No.: 15/677,622

(22) Filed: Aug. 15, 2017

(65) Prior Publication Data

US 2019/0055912 A1 Feb. 21, 2019

(51) Int. Cl.

| | |
|---|---|
| ***F02N 19/10*** | (2010.01) |
| ***F01P 11/02*** | (2006.01) |
| ***F01P 3/20*** | (2006.01) |
| *F01P 11/14* | (2006.01) |
| *F01P 5/12* | (2006.01) |

(Continued)

(52) U.S. Cl.

CPC ..... *F02N 19/10* (2013.01); *F01P 3/20* (2013.01); *F01P 11/029* (2013.01); *F01P 11/028* (2013.01); *F01P 11/0285* (2013.01); *F01P 11/14* (2013.01); *F01P 2005/105* (2013.01); *F01P 2005/125* (2013.01); *F01P 2011/205* (2013.01); *F01P 2031/30* (2013.01); *F01P 2037/02* (2013.01)

(58) Field of Classification Search

CPC F01P 3/20; F01P 11/029; F01P 11/028; F01P 11/0285

See application file for complete search history.

(56) References Cited

U.S. PATENT DOCUMENTS

| | | | |
|---|---|---|---|
| 3,498,539 | A | 3/1970 | Boehmfeld et al. |
| 5,388,420 | A | 2/1995 | Yoshida et al. |
| 5,662,072 | A | 9/1997 | Suzuki et al. |

(Continued)

FOREIGN PATENT DOCUMENTS

| | | | |
|---|---|---|---|
| JP | S56107916 | A | 8/1981 |
| JP | H08200069 | A | 8/1996 |

(Continued)

OTHER PUBLICATIONS

SAE Technical Paper 950994 titled "Insulated Expansion Tank (IET) and Thermal Storage for Engine Cold Start," by N. S. Ap and N. C. Golm (4 pages).

*Primary Examiner* — Kevin A Lathers

(74) *Attorney, Agent, or Firm* — Harness, Dickey & Pierce, P.L.C.

(57) ABSTRACT

A temperature control system for an engine. The system includes a thermal storage expansion tank defining a thermally insulated interior volume for storing engine coolant. The system further includes a pump that pumps engine coolant that has exited the thermal storage expansion tank back into the thermally insulated interior volume of the thermal storage expansion tank and forces air out of the thermal storage expansion tank to store coolant in the thermally insulated interior volume when the engine is off.

14 Claims, 1 Drawing Sheet

Figure 1:
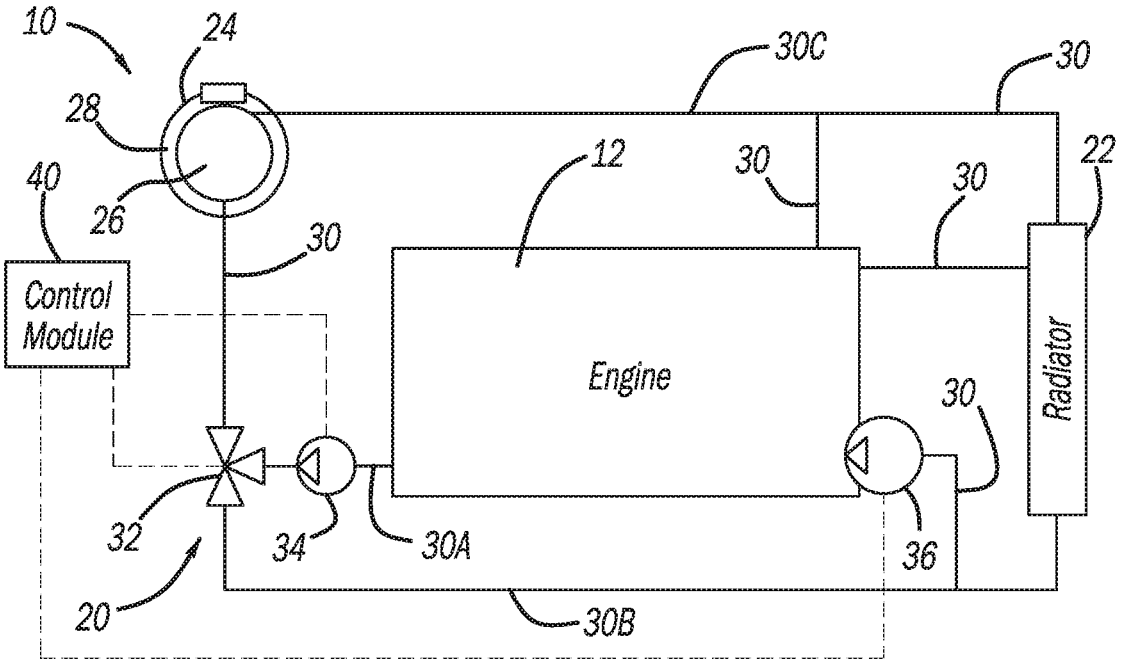

(51) Int. Cl.
*F01P 5/10* (2006.01)
*F01P 11/20* (2006.01)

(56) References Cited

U.S. PATENT DOCUMENTS

| | | | | | |
|---|---|---|---|---|---|
| 5,701,852 | A | * | 12/1997 | Suzuki | F01P 7/162 123/142.5 R |
| 5,749,330 | A | | 5/1998 | Inque et al. | |
| 5,765,511 | A | | 6/1998 | Schatz | |
| 8,613,305 | B2 | | 12/2013 | Yu | |
| 8,794,195 | B2 | | 8/2014 | Levin et al. | |
| 8,931,299 | B2 | | 1/2015 | Major et al. | |
| 9,027,516 | B2 | | 5/2015 | Park | |
| 9,074,826 | B2 | | 7/2015 | Haupts | |
| 9,458,752 | B2 | | 10/2016 | Carstensen et al. | |
| 9,726,069 | B2 | * | 8/2017 | Styron | F01P 11/18 |
| 2005/0229873 | A1 | | 10/2005 | Willers | |
| 2007/0044938 | A1 | | 3/2007 | Farley | |
| 2015/0013328 | A1 | | 1/2015 | Carstensen et al. | |
| 2015/0034026 | A1 | | 2/2015 | Schatz | |
| 2015/0136048 | A1 | | 5/2015 | Sundemo et al. | |
| 2016/0334154 | A1 | | 11/2016 | Srichai et al. | |
| 2016/0356553 | A1 | | 12/2016 | Lenk et al. | |

FOREIGN PATENT DOCUMENTS

| | | | |
|---|---|---|---|
| JP | H09013964 | A | 1/1997 |
| JP | 2009250147 | A | 10/2009 |
| WO | WO-1997019266 | A1 | 5/1997 |
| WO | WO-2010052410 | A1 | 5/2010 |
| WO | WO-2015114225 | A1 | 8/2015 |
| WO | WO-2015128762 | A2 | 9/2015 |

* cited by examiner

THERMAL STORAGE EXPANSION TANK

FIELD

The present disclosure relates to a thermal storage expansion tank for warmed engine coolant, and storing the warmed coolant for use during a cold engine start to facilitate engine warmup.

BACKGROUND

This section provides background information related to the present disclosure, which is not necessarily prior art.

Coolant thermal storage systems store warm coolant, which at a cold engine start is circulated through the engine to facilitate engine warmup. While current coolant thermal storage systems are suitable for their intended use, they are subject to improvement. For example, existing thermal storage systems maintain a set coolant volume (3 liters for example) at a warmed-up temperature during periods when the engine is off (overnight for example). The coolant is kept warm in a tank with high insulating properties and/or phase change material. When the engine is turned on again, the warm coolant is allowed to circulate through the engine, aiding rapid warm-up. Thus existing thermal storage systems add coolant volume, which undesirably increases the mass of the coolant system. Packaging is also a significant challenge, because finding space under-hood for several liters of coolant storage can be virtually impossible on a modern passenger vehicle. As explained herein, the present teachings advantageously ease packaging concerns and eliminate the need to add coolant volume.

SUMMARY

This section provides a general summary of the disclosure, and is not a comprehensive disclosure of its full scope or all of its features.

The present teachings provide for a temperature control system for an engine. The system includes a thermal storage expansion tank defining a thermally insulated interior volume for storing engine coolant. The system further includes a pump that pumps engine coolant that has exited the thermal storage expansion tank back into the thermally insulated interior volume of the thermal storage expansion tank and forces air out of the thermal storage expansion tank to store coolant in the thermally insulated interior volume when the engine is off.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Figure 2:
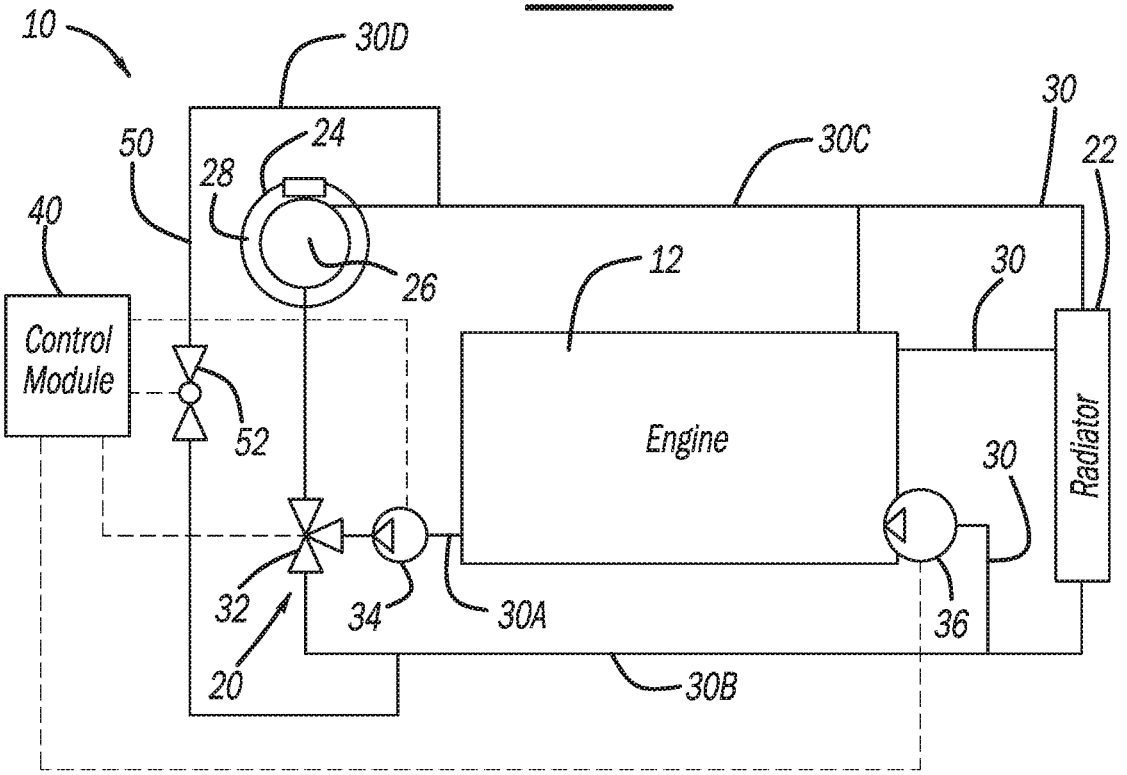

FIG. 1 illustrates an engine temperature control system in accordance with the present teachings; and FIG. 2 illustrates another engine temperature control system in accordance with the present teachings.

Corresponding reference numerals indicate corresponding parts throughout the several views of the drawings.

DETAILED DESCRIPTION

Example embodiments will now be described more fully with reference to the accompanying drawings.

FIG. 1 illustrates a temperature control system 10 in accordance with the present teachings for controlling temperature of an engine 12. The engine 12 can be any suitable type of engine, such as an internal combustion engine. The engine 12 can be a vehicle engine, such as for a passenger vehicle, mass-transit vehicle, military vehicle, construction vehicle (or any construction equipment), aircraft, watercraft, etc. The engine 12 may also be any suitable non-vehicular engine, such as a generator engine for example.

The temperature control system 10 includes a coolant flow control system 20 for directing coolant to and from the engine 12. The coolant can be any coolant suitable for regulating temperature of the engine 12, such as water, etc. The coolant flow control system 20 specifically circulates coolant through the engine 12, a radiator 22, and a thermal storage expansion tank 24. The thermal storage expansion tank 24 defines an interior volume 26, which coolant and air can be pumped into and out of. The interior volume 26 is insulated in any suitable manner, such as with insulation 28. The insulation 28 can be any insulation suitable for keeping coolant stored within the interior volume 26 warm.

The coolant flow control system 20 further includes a plurality of conduits 30. The conduits 30 can be any suitable conduits for fluidly connecting the engine 12, the radiator 22, and the thermal storage expansion tank 24. For example, the conduits 30 can include a plurality of fluid hoses or pipes arranged as illustrated in FIGS. 1 and 2.

The coolant flow control system 20 further includes a valve 32, a first pump 34, and a second pump 36. The valve 32 can be any valve suitable for controlling coolant flow as described herein, such as a three-way valve. The three-way valve 32 may be controlled in any suitable manner. For example, the three-way valve 32 may be an electric valve controlled by control module 40.

The first pump 34 is arranged between the valve 32 and the engine 12 along one of the conduits 30A. The first pump 34 can be any suitable pump, such as an electric pump. The first pump 34 is configured to pump coolant away from the engine 12 and back into the thermal storage expansion tank 24, as explained in detail herein. The second pump 36 is configured to pump coolant to the engine 12, as explained in detail herein. The second pump 36 can be any suitable pump, such as a mechanical pump.

The valve 32, the first pump 34, and the second pump 36 can be controlled in any suitable manner, such as by any suitable control module 40. The control module 40 is configured to operate the valve 32 in order to control flow of coolant therethrough, as described herein. Control module 40 is also configured to activate and deactivate, as well as control the speed of, the first pump 34 and the second pump 36 respectively as explained herein. In this application, the term "module" or the term "controller" may be replaced with the term "circuit." The term "module" may refer to, be part of, or include processor hardware (shared, dedicated, or group) that executes code and memory hardware (shared, dedicated, or group) that stores code executed by the processor hardware. The code is configured to provide the features of the control module described herein. The term memory hardware is a subset of the term computer-readable medium. The term computer-readable medium does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

Exemplary operation of the temperature control system 10 will now be described in detail. In a normal driving mode, the valve 32 is configured to restrict coolant from flowing to the engine 12 across the first pump 34 by way of conduit 30A. The valve 32 is so configured in any suitable manner, such as by the control module 40. The control module 40 also activates the second pump 36 in order to pump coolant from the thermal storage expansion tank 24 to the engine 12. The first pump 34 is not activated. In this normal driving mode, the thermal storage expansion tank 24 functions as an expansion tank to allow heated coolant therein to expand, and allow the system 10 to degas.

When the engine 12 is turned off, the valve 32 is configured (such as by the control module 40) to restrict coolant flow through the valve 32 to the engine 12 by way of conduit 30B. The control module 40 deactivates the second pump 36, and activates the first pump 34. The first pump 34 pumps coolant back into the thermal storage expansion tank 24, and forces air out from within the tank 24. Thus the system 10 enters an air removal mode when the engine is turned off. The first pump 34 completely fills (or nearly completely fills) the thermal storage expansion tank 24 with coolant, and forces air out from within the tank 24 into conduit 30C. Forcing air out from within the thermal storage expansion tank 24 advantageously maximizes the thermal storage volume of the tank 24. After the thermal storage expansion tank 24 has been filled with coolant, the control module 40 deactivates the first pump 34 and closes the valve 32 to prevent coolant from flowing through the valve 32 and to maintain the tank 24 full of coolant in a thermal storage mode of the system 10. The insulation 28 of the thermal storage expansion tank 24 will keep the coolant warm for an extended period of time, such as while the engine 12 is off overnight (i.e., when a vehicle including the engine 12 is parked overnight).

When the engine 12 is turned back on, the control module 40 activates an air recovery mode. In the air recovery mode, the valve 32 is configured (such as by the control module 40) to allow coolant to flow therethrough to the conduit 30B, but restrict coolant flow to the conduit 30A. The first pump 34 is maintained in the deactivated state, but the second pump 36 is activated (such as by the control module 40) to pump coolant from the thermal storage expansion tank 24, which has been kept warm by the tank 24, to the engine 12 to warm the engine 12 and facilitate heating of the engine 12 to its optimal operating temperature. As the second pump 36 pumps coolant from the thermal storage expansion tank 24 to the engine 12, air that was previously forced out of the tank 24 and into the conduit 30C moves back into the tank 24. With both coolant and air in the tank 24, the tank 24 resumes its function as a thermal expansion tank to allow heated coolant therein to expand and to degas the system 10.

With reference to FIG. 2, the system 10 can include a bypass 50, which has a bypass valve 52 arranged along a bypass conduit 30D. The bypass conduit 30D of the bypass 50 extends from the conduit 30C to the conduit 30B. Thus coolant flowing through the bypass 50 does not flow through the thermal storage expansion tank 24 or the valve 32. The bypass 50 allows for the system 10 to operate in an engine warm-up mode. In the engine warm-up mode, the valve 32 is closed (such as by the control module 40) to restrict coolant flow therethrough. The control module 40 also opens the bypass valve 52, which is closed in the normal driving mode, the air removal mode, the thermal storage mode, and the air recovery mode described above. In the engine warm-up mode the control module 40 activates the second pump 36, but not the first pump 34. The engine warm-up mode is activated after the warmed coolant stored in the tank 24 has been pumped from the tank 24 to the engine 12, and thus the tank 24 no longer includes warmed coolant. To reduce the amount of cold coolant that must be warmed by the engine, the engine warm-up mode is activated to isolate the thermal storage expansion tank 24 from the rest of the system 10, and pump coolant to the engine 12 directly from the conduit 30C rather than from the tank 24.

The present teachings provide for numerous advantages. For example, the tank 24 operates as an expansion tank when the engine 12 is running and as a thermal storage tank for storing warm coolant when the engine is off. The tank 24 is thus advantageously a single component that does the job of two components, thereby saving materials, costs, and space (such as space under a vehicle hood). Since the coolant volume of the tank 24 is already factored into the total volume of the system 10, there is no need to add additional volume to provide the tank 24 with the above-described thermal storage capability. Furthermore, the bypass 50 advantageously allows the tank 24 to be isolated during engine warmup, which allows for reduction of coolant volume that needs to be warmed during a cold engine start. This reduces engine warm-up time as compared to existing thermal storage tanks.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A temperature control system for an engine, the system comprising:

a thermal storage expansion tank;

a pump that pumps engine coolant out of the engine and into the thermal storage expansion tank to store the coolant and force air out of the thermal storage expansion tank when the engine is off; and a valve between the pump and the thermal storage expansion tank, in a first configuration the valve permits coolant flow therethrough from the thermal storage expansion tank to the engine and restricts coolant flow to the pump, in a second configuration the valve permits coolant pumped out of the engine by the pump to flow through the valve into the thermal storage expansion tank, and in a third configuration the valve restricts coolant flow therethrough to prevent coolant from flowing out of the thermal storage expansion tank to the engine.

2. The system of claim 1, further comprising a radiator in receipt of engine coolant flowing from the engine.

3. The system of claim 1, wherein the pump is an electric pump.

4. The system of claim 1, wherein the valve is a three-way valve.

5. The system of claim 1, wherein the valve is in the first configuration when the engine is on to allow coolant within the thermal storage expansion tank to expand and allow the system to degas.

6. A temperature control system for an engine, the system comprising:

a thermal storage expansion tank for storing engine coolant;

a radiator;

a coolant flow control system connecting the thermal storage expansion tank, the radiator, and the engine to permit coolant flow therebetween;

a first pump configured to pump coolant out of the engine and into the thermal storage expansion tank, thereby forcing air out from within the thermal storage expansion tank;

a second pump configured to pump coolant into the engine from the thermal storage expansion tank; and a three-way valve connected to a first conduit extending to the thermal storage expansion tank, a second conduit extending to the first pump, and a third conduit extending to the second pump;

wherein:

when the engine is on, the second pump is active and the three-way valve is configured to permit coolant flow therethrough from the thermal storage expansion tank to the engine by way of the third conduit and restrict coolant flow to the second conduit;

when the engine is off, the first pump is active and the three-way valve is configured to permit coolant pumped out of the engine by the first pump to flow through the three-way valve and into the thermal storage expansion tank to store coolant heated by the engine and remove air from within the thermal expansion tank, and after the thermal storage expansion tank is filled with coolant the three-way valve is configured to restrict coolant from flowing through the three-way valve; and when the engine is turned back on, the three-way valve is configured to permit coolant flow therethrough from the thermal storage expansion tank to the engine by way of the third conduit and restrict coolant flow to the second conduit.

7. The system of claim 6, wherein the second pump is a mechanical pump.

8. The system of claim 6, wherein the first pump is an electric pump.

9. The system of claim 6, wherein the first pump is arranged along the coolant flow control system between the engine and the three-way valve.

10. The system of claim 6, wherein the coolant flow control system further includes a bypass line directing coolant around the thermal storage expansion tank such that coolant does not flow to the thermal storage expansion tank.

11. The system of claim 10, further comprising a bypass valve arranged along the bypass line, the bypass valve controls coolant flow through the bypass line.

12. A method for controlling temperature of an engine, the method comprising:

pumping engine coolant that has exited a thermal storage expansion tank back into the thermal storage expansion tank, and forcing air out from within the thermal storage expansion tank, to store coolant in the thermal storage expansion tank when the engine is off;

directing the coolant stored within the thermally insulated interior volume of the thermal storage expansion tank to the engine when the engine is restarted to facilitate warmup of the engine; and controlling coolant flow to and from the thermal storage expansion tank with a three-way valve arranged along a coolant flow path between a pump that performs the pumping and the thermal storage expansion tank, in a first configuration the valve permits coolant flow therethrough from the thermal storage expansion tank to the engine and restricts coolant flow to the pump, in a second configuration the valve permits coolant pumped out of the engine by the pump to flow through the valve into the thermal storage expansion tank, and in a third configuration the valve restricts coolant flow therethrough to prevent coolant from flowing to the engine.

13. The method of claim 12, further comprising maintaining both air and coolant within the thermal storage expansion tank when the engine is on.

14. The method of claim 12, further comprising directing coolant around the thermal storage expansion tank through a bypass line such that the coolant does not flow to the thermal storage expansion tank after the engine is restarted and air is introduced into the thermal storage expansion tank.

* * * * *